US008777731B2

(12) United States Patent
Miller et al.

(10) Patent No.: US 8,777,731 B2
(45) Date of Patent: Jul. 15, 2014

(54) DYNAMIC CONFIGURATION OF WAGERING GAMES

(75) Inventors: William C. Miller, Reno, NV (US); Eucke W. Warren, Sparks, NV (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/368,472

(22) Filed: Feb. 8, 2012

(65) Prior Publication Data

US 2013/0203481 A1 Aug. 8, 2013

(51) Int. Cl.
*A63F 9/00* (2006.01)

(52) U.S. Cl.
USPC ..... 463/25

(58) Field of Classification Search
None
See application file for complete search history.

(56) References Cited

U.S. PATENT DOCUMENTS

| | | | | |
|---|---|---|---|---|
| 6,068,552 | A * | 5/2000 | Walker et al. | 463/21 |
| 6,520,856 | B1 * | 2/2003 | Walker et al. | 463/21 |
| 6,569,207 | B1 * | 5/2003 | Sundaresan | 715/234 |
| 7,249,345 | B2 * | 7/2007 | Zorc | 717/106 |
| 7,749,066 | B2 * | 7/2010 | Hartman et al. | 463/19 |
| 7,980,948 | B2 * | 7/2011 | Rowe et al. | 463/29 |
| 8,177,620 | B2 * | 5/2012 | Miles et al. | 463/16 |
| 8,200,684 | B2 * | 6/2012 | Seitz et al. | 707/759 |
| 8,323,099 | B2 * | 12/2012 | Durham et al. | 463/25 |
| 8,323,101 | B2 * | 12/2012 | Anderson et al. | 463/27 |
| 2003/0149934 | A1 * | 8/2003 | Worden | 715/513 |
| 2003/0167444 | A1 * | 9/2003 | Zorc | 715/513 |
| 2003/0226109 | A1 * | 12/2003 | Adamson et al. | 715/513 |
| 2004/0148612 | A1 * | 7/2004 | Olsen | 719/328 |
| 2005/0192088 | A1 * | 9/2005 | Hartman et al. | 463/27 |
| 2006/0101392 | A1 * | 5/2006 | Isaza | 717/108 |
| 2006/0155720 | A1 * | 7/2006 | Feinberg | 707/100 |
| 2007/0060302 | A1 * | 3/2007 | Fabbri | 463/24 |
| 2007/0243928 | A1 * | 10/2007 | Iddings | 463/26 |
| 2008/0146344 | A1 * | 6/2008 | Rowe et al. | 463/42 |
| 2008/0248865 | A1 * | 10/2008 | Tedesco et al. | 463/25 |
| 2008/0268934 | A1 * | 10/2008 | Mattice et al. | 463/16 |
| 2009/0150423 | A1 * | 6/2009 | Spanton et al. | 707/102 |
| 2010/0291998 | A1 * | 11/2010 | Anderson et al. | 463/27 |
| 2011/0088011 | A1 * | 4/2011 | Ouali | 717/105 |
| 2011/0124401 | A1 * | 5/2011 | Durham et al. | 463/25 |
| 2011/0300926 | A1 * | 12/2011 | Englman et al. | 463/25 |
| 2012/0309508 | A1 * | 12/2012 | Anderson et al. | 463/27 |

(Continued)

OTHER PUBLICATIONS

"BlackWasp", http://www.blackwasp.co.uk/RuntimeCompilation.aspx Date Obtained from the Internet: Jan. 5, 2012 Last Date Modified: Sep. 25, 2011 , 2 pages.

(Continued)

*Primary Examiner* — Seng H Lim
(74) *Attorney, Agent, or Firm* — DeLizio Gilliam, PLLC

(57) ABSTRACT

A wagering game system and its operations are described herein. In some embodiments, the operations can include obtaining a mathematical expression(s) from a configuration file associated with a wagering game. The mathematical expression(s) include elements that represent game-related parameters of the one or more wagering games. In some embodiments, the operations further comprise converting the mathematical expression(s) to a programming code expression(s) equivalent to the mathematical expression(s) in response to detection of user-input to configure the wagering game for use via a wagering game machine. In some embodiments, the operations further comprise evaluating the programming code expression(s) using values for the one or more game-related parameters, and configuring the one or more wagering games based on evaluation of the programming code expression(s) using the values for the one or more game-related parameters.

29 Claims, 6 Drawing Sheets

(56) References Cited

U.S. PATENT DOCUMENTS

| | | | | |
|---|---|---|---|---|
| 2013/0024487 | A1* | 1/2013 | Yi | 708/136 |
| 2013/0084946 | A1* | 4/2013 | Hornik et al. | 463/21 |
| 2013/0095864 | A1* | 4/2013 | Marovets | 455/466 |

OTHER PUBLICATIONS

Cuprjak, Marcin , "Evaluating Mathematical Expressions by Compiling C# Code at Runtime", *The Code Project* http://www.codeproject.com/KB/recipes/matheval.aspx Date Obtained from the Internet: Jan. 26, 2012 Apr. 21, 2003 , 3 pages.

Gold, Mike , "CodeDom Calculator—Evaluating C# Math Expressions dynamically", *C# Corner* http://www.c-sharpcorner.com/UploadFile/mgold/CodeDomCalculator08082005003253AM/CodeDo mCalculator.aspx Date Obtained from the Internet: Jan. 26, 2012 Aug. 8, 2005 , 11 pages.

Microsoft, , "Dynamic Source Code Generation and Compilation", *MSDN* http://msdn.microsoft.com/en-us/library/650ax5cx.aspx Date Obtained from the Internet: Jan. 5, 2012 2012 , 2 pages.

Raja, , "The Java 6.0 Compiler API", *JavaBeat* http://www.javabeat.net/articles/73-the-java-60-compiler-api-l.html Date Obtained from the Internet: Jan. 5, 2012 2004 , 12 pages.

Ricci, Ignacio , "C# Dynamic Expression Evaluation", *DevReminder* http://devreminder.wordpress.com/net/net-framework-fundamentals/c-dynamic-math-expression-evaluation/ Date Obtained from the Internet: Jan. 26, 2012 , 4 pages.

Richards, Norman , "Dynamic Code Generation", *JDJ* http:///java.sys-con.com/node/36843 Date Obtained from the Internet: Jan. 26, 2012 Feb. 1, 2002 , 6 pages.

Wizard12, , "Dynamic Code Generation and Code Compilation", *The Code Project* http://www.codeproject.com/KB/dotnet/dynacodgen.aspx?display=Print Date Obtained from the Internet: Jan. 5, 2012 Dec. 2, 2002 , 4 pages.

* cited by examiner

DYNAMIC CONFIGURATION OF WAGERING GAMES

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2012, WMS Gaming, Inc.

TECHNICAL FIELD

Embodiments of the inventive subject matter relate generally to wagering game systems and networks that, more particularly, dynamically configure wagering games and wagering game machines.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

Furthermore, wagering game manufacturers create tools that operators of casinos, and other gaming establishments, can use to configure wagering game machines with the wagering games provided by the wagering game manufacturer. One such tool is a remote configuration and download (RCD) tool that an operator can use to remotely configure wagering game machines, that are within a gaming establishment, with wagering games. For example, using an RCD tool, the operator assigns specific pay tables, betting limitations, etc. for the wagering games based on a range of potential expected values (EV) for the wagering games as dictated by jurisdiction. An EV is an expected amount of winnings that one or more wagering games are expected to pay out over time on a particular wagering game machine. Different jurisdictions have different required EV limits or ranges. The RCD tool assists with computing EV's for wagering games, comparing those EV's to jurisdictional rules, and presenting to the operator specific gaming settings, such as pay tables, maximum bet values, denominations, etc., that are allowable (e.g., within jurisdictional limits or ranges) based on the jurisdictional rules for the casino, or other gaming establishment, in which the wagering game machine resides.

Some wagering game manufacturers hard code functions for EVs into their RCD tool, which hard coded functions are used, by the operator, via use of the RCD tool, to determine EVs and configure wagering games. Each wagering game can have different hard-coded EV functions, and a wagering game manufacturer can offer scores of games. Further, the RCD tool can include hard-coded EV functions for combinations of primary and secondary wagering games. Thus, an RCD tool can have hundreds of hard-coded EV functions. The hard-coded EV functions are part of the RCD tool's source code, which is the programming code that the wagering game manufacturer compiles to generate versions of the RCD tool to send to the operators. However, use of hard-coded EV functions for an RCD tool presents certain challenges. For example, every time the wagering game manufacturer updates even one of the EV formulas for a given game the RCD tool's source code must be similarly changed and the wagering game manufacturer must rigorously test the entire RCD tool to ensure that the adjustment to source code does not cause errors or other unexpected effects to the overall functionality of the RCD tool. Furthermore, whenever the source code of the RCD tool is modified, the new version of the RCD tool that results from that modification to the source code must be approved by jurisdictional regulators before it can be distributed to the operators of the gaming establishments. The jurisdictional regulators must also perform testing to the entire RCD tool. Therefore, even if one adjustment to one wagering game's EV is modified, the overall effort to modify, test, and approve the updated RCD tool requires significant resources and takes significant time.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

As described previously, use of hard-coded EV functions in an RCD tool can present certain challenges. Some embodiments of the inventive subject matter, however, include an RCD tool that does not rely on hard-coded EV functions for primary wagering game, secondary wagering games, or combinations of primary and secondary games, but instead uses a separate file for each separate wagering game. Each separate file includes raw mathematical functions for the wagering game and/or includes functions for the wagering game in combination with other wagering games with which it is compatible. The RCD tool, according to some embodiments, detects a request to configure a wagering game machine with one or more wagering games and dynamically evaluates the mathematical functions stored in the files. The RCD tool can then use the results of the evaluation of the mathematical functions from the files to configure wagering games and wagering game machines within the casino.

Figure 1:
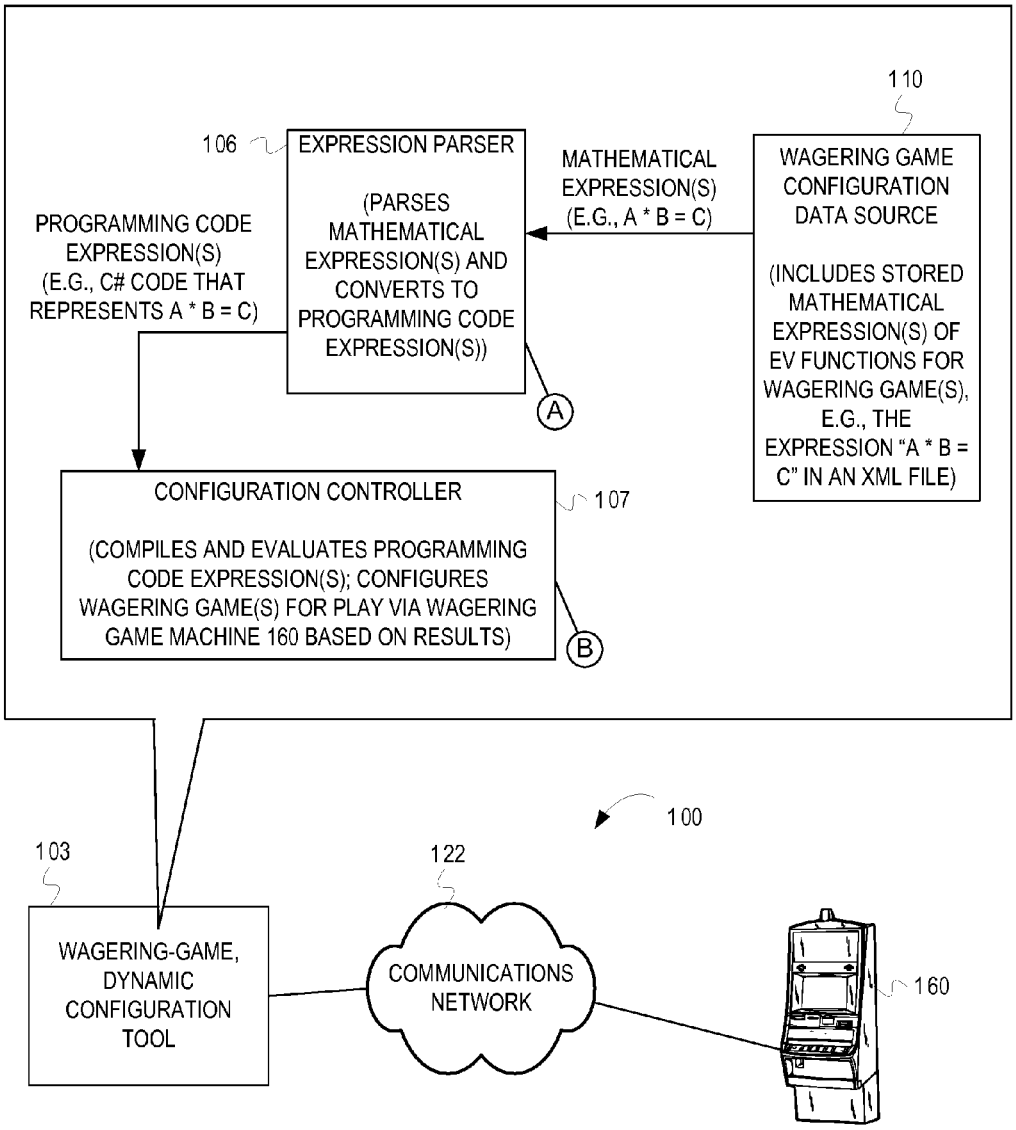
FIG. 1 is an illustration of dynamically configuring wagering-game environments, according to some embodiments.

FIG. 1 is a conceptual diagram that illustrates an example of dynamically configuring wagering-game environments, according to some embodiments. In FIG. 1, a wagering game system ("system") 100 includes a wagering-game, dynamic configuration tool ("configuration tool") 103 connected to a wagering game machine 160 via a communications network 122. The system 100 is configured to store wagering game configuration data in a wagering game configuration data source ("data source") 110, such as a configuration file (e.g., an XML file), a database, an online data storage unit, etc. The data source includes data such as mathematical expressions for EV functions ("mathematical expressions"). The mathematical expressions include elements that represent gaming parameters that are used to evaluate the EV for the wagering game. The gaming parameters may be, for example, symbols that represent values that are relevant during play of the wagering game during a wagering game session, such as a maximum bet amount for a wagering game, a minimum denomination value for the wagering game, an amount of extra bet for the wagering game, and so forth. For example, one mathematical expression, "A*B=C," may compute to an EV for a wagering game (i.e., "C" is a symbol that represents the EV for the game, where "A" and "B" are symbols that represent any one of the gaming parameters, such as the maximum bet, minimum denomination, extra bet, etc. for the wagering game).

At stage "A," the system 100 reads data from the data source 110, such as one or more of the mathematical expressions ("mathematical expression(s)") for the EV functions. An expression parser 106 reads the elements contained within the mathematical expression(s), such as the symbols that represent the wagering game parameters. Also at stage "A," the expression parser 106 generates programming code that corresponds to the mathematical expression(s) (e.g., the expression parser 106 converts the mathematical expression (s) to corresponding programming code expression(s)).

At stage "B," the system 100, such as via a configuration controller 107, evaluates the programming code expression (s) to generate a result. The result of evaluating the expression (s) is a gaming value, such as an EV associated with the wagering game. The configuration controller 107 utilizes the result for configuration of the wagering game for use via the wagering game machine 160. For example, the configuration tool 103 compares the EV to jurisdictional rules and determines allowable configuration settings (e.g., pay tables, maximum bet values, denominations, etc.) based on the EV. For instance, in one embodiment, the system 100 uses the EV to filter a set of pay tables for specific denominations to determine which of the pay tables correspond to specific ranges for the EV that are allowed for a type of the wagering game based on the jurisdictional rules that limit the EV to the specific ranges. The system 100 can present the allowable pay tables for a user to select and/or assign to the wagering game via the user interface of the configuration tool 103. Therefore, in some embodiments, the system 100 can avoid having to rely on hard-coded, mathematical EV expressions within compiled executable files that were from source code for the configuration tool 103. Instead, the system 100 parses the raw mathematical data associated with the mathematical expression(s) from the data source 100, and converts them into the programming code at runtime. In other words, the system 100 can perform the operations at runtime, for instance within the gaming establishment, in response to a request by a user to configure the wagering game machine 160 with wagering games. In some embodiments, the system 100 reads the data from the data source 110 in response to user input via the configuration tool 103. For example, the configuration tool 103 is configured to present a user interface through which a user can select one or more objects that represent one or more specific wagering game machine(s) and/or group of wagering game machines, such as the wagering game machine 160. When the operator selects an object that represents the wagering game machine 160, the configuration tool 103 is configured to assist in configuring the wagering games for the wagering game machine 160 by performing the operations described in stages A and B to generate an EV result. The configuration tool 103 can then present options, such as the allowable configuration settings (e.g., pay tables, maximum bet values, denominations, etc.) for the user to select based on the EV result.

Although FIG. 1 describes some embodiments, the following sections describe many other features and embodiments. Some embodiments of the inventive subject matter include examples of dynamic configuration of wagering games in a network wagering venue (e.g., an online casino, a wagering game website, a wagering network, etc.) using a communication network, such as the communications network 122 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Example Operating Environments

This section describes example operating environments and networks and presents structural aspects of some embodiments. More specifically, this section includes discussion about wagering game system architectures and wagering game systems.

Dynamic-Configuration Wagering Game Architecture

Figure 2:
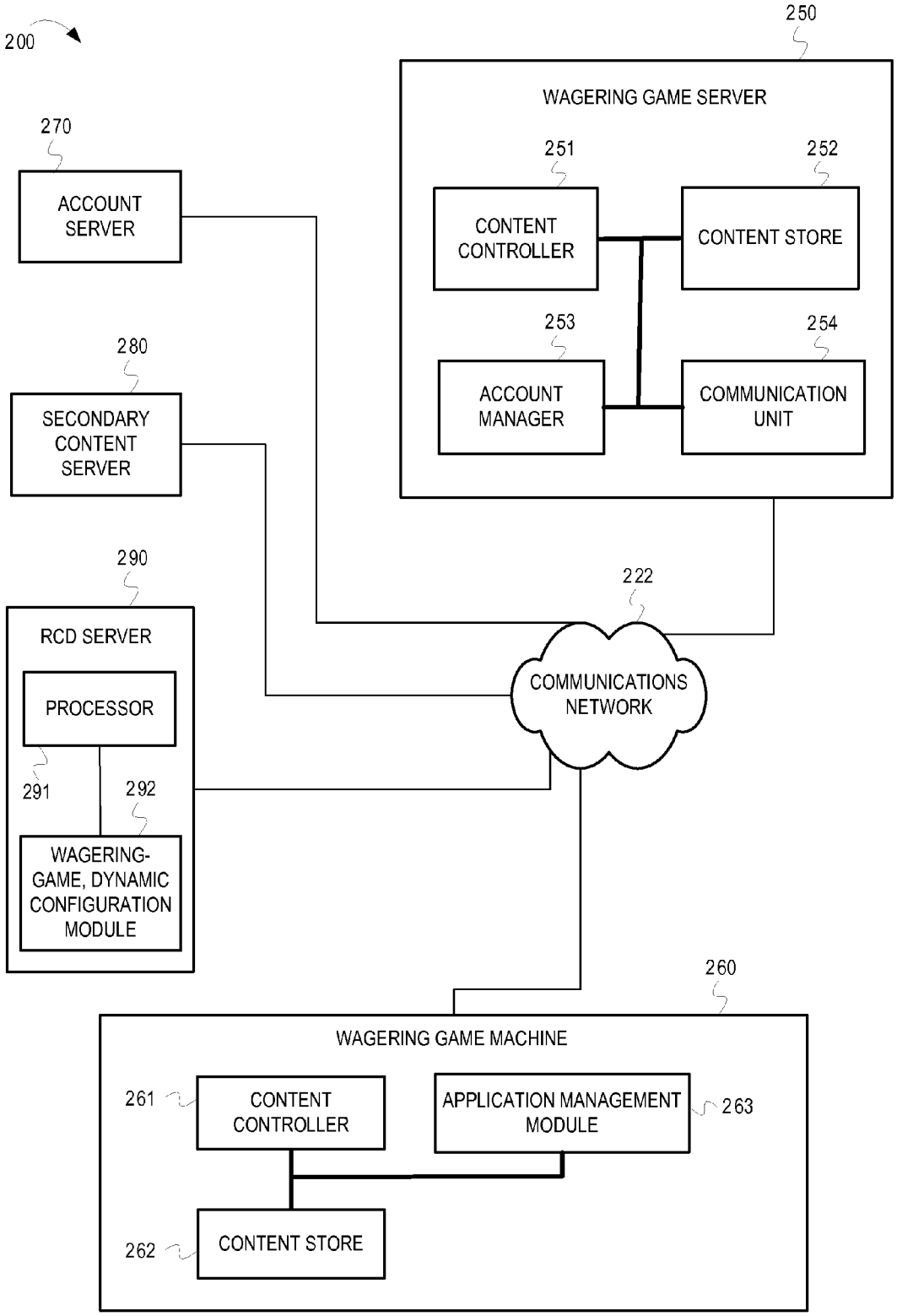
FIG. 2 is a conceptual diagram that illustrates an example wagering game system architecture 200, according to some embodiments.

FIG. 2 is a conceptual diagram that illustrates an example wagering game system architecture 200, according to some embodiments. The wagering game system architecture 200 can include an account server 270 configured to control user related accounts accessible via wagering game networks and social networks. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers.

The wagering game system architecture 200 can also include a wagering game server 250 configured to control wagering game content, provide random numbers, and communicate wagering game information, account information, and other information to and from a wagering game machine 260. The wagering game server 250 can include a content controller 251 configured to manage and control content for presentation on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 can also include a content store 252 configured to contain content to present on the wagering game machine 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the wagering game machine 260 and to communicate with other systems, devices and networks.

The wagering game system architecture 200 can also include the wagering game machine 260 configured to present wagering games and receive and transmit information to dynamically configure wagering games and wagering game machines. The wagering game machine 260 can include a content controller 261 configured to manage and control content and presentation of content on the wagering game machine 260. The wagering game machine 260 can also include a content store 262 configured to contain content to present on the wagering game machine 260. The wagering game machine 260 can also include an application management module 263 configured, in some embodiments, to control presentation of secondary wagering games in concert with primary wagering games. The application management module 263 can manage multiple instances of gaming applications. For example, the application management module 263 can be configured to launch, load, unload and control applications and instances of applications. The application management module 263 can launch different software players (e.g., a Microsoft® Silverlight™ player, an Adobe® Flash® player, etc.) and manage, coordinate, and prioritize what the software players do. The application management module 263 can also coordinate instances of server applications in addition to local copies of applications. The application management module 263 can control window locations on a wagering game screen or display for the multiple gaming applications. In some embodiments, the application management module 263 can manage window locations on multiple displays including displays on devices associated with and/or external to the wagering game machine 260 (e.g., a top display and a bottom display on the wagering game machine 260, a peripheral device connected to the wagering game machine 260, a mobile device connected to the wagering game machine 260, etc.). The application management module 263 can manage priority or precedence of client applications that compete for the same display area. For instance, the application management module 263 can determine each client application's precedence. The precedence may be static (i.e. set only when the client application first launches or connects) or dynamic. The applications may provide precedence values to the application management module 263, which the application management module 263 can use to establish order and priority. The precedence, or priority, values can be related to tilt events, administrative events, primary game events (e.g., hierarchical, levels, etc.), secondary game events, local bonus game events, advertising events, etc. As each client application runs, it can also inform the application management module 263 of its current presentation state. The applications may provide presentation state values to the application management module 263, which the application management module 263 can use to evaluate and assess priority. Examples of presentation states may include celebration states (e.g., indicates that client application is currently running a win celebration), playing states (e.g., indicates that the client application is currently playing), game starting states (e.g., indicates that the client application is showing an invitation or indication that a game is about to start), status update states (e.g., indicates that the client application is not 'playing' but has a change of status that should be annunciated, such as a change in progressive meter values or a change in a bonus game multiplier), idle states (e.g., indicates that the client application is idle), etc. In some embodiments, the application management module 263 can be pre-configurable. The system can provide controls and interfaces for operators to control screen layouts and other presentation features for the configuring of the application management module 263. The application management module 263 can communicate with, and/or be a communication mechanism for, a base game stored on a wagering game machine. For example, the application management module 263 can communicate events from the base game such as the base game state, pay line status, bet amount status, etc. The application management module 263 can also provide events that assist and/or restrict the base game, such as providing bet amounts from secondary gaming applications, inhibiting play based on gaming event priority, etc. The application management module 263 can also communicate some (or all) financial information between the base game and other applications including amounts wagered, amounts won, base game outcomes, etc. The application management module 263 can also communicate pay table information such as possible outcomes, bonus frequency, etc.

In some embodiments, the application management module 263 can control different types of applications. For example, the application management module 263 can perform rendering operations for presenting applications of varying platforms, formats, environments, programming languages, etc. For example, the application management module 263 can be written in one programming language format (e.g., Javascript, Java, C++, etc.) but can manage, and communicate data from applications that are written in other programming languages or that communicate in different data formats (e.g., Adobe® Flash®, Microsoft® Silverlight™, Adobe® Air™, hyper-text markup language, etc.). The application management module 263 can include a portable virtual machine capable of generating and executing code for the varying platforms, formats, environments, programming languages, etc. The application management module 263 can enable many-to-many messaging distribution and can enable the multiple applications to communicate with each other in a cross-manufacturer environment at the client application level. For example, multiple gaming applications on a wagering game machine may need to coordinate many different types of gaming and casino services events (e.g., financial or account access to run spins on the base game and/or run side bets, transacting drink orders, tracking player history and player loyalty points, etc.).

The wagering game system architecture 200 can also include a secondary content server 280 configured to provide content and control information for secondary games and other secondary content available on a wagering game network (e.g., secondary wagering game content, promotions content, advertising content, player tracking content, web content, etc.). The secondary content server 280 can provide "secondary" content, or content for "secondary" games presented on the wagering game machine 260. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 280 can provide and control content for community games, including networked games, social games, competitive games, or any other game that multiple players can participate in at the same time. In some embodiments, the secondary content server 280 can control and present an online website that hosts wagering games. The secondary content server 280 can also be configured to present multiple wagering game applications on the wagering game machine 260 via a wagering game website, or other gaming-type venue accessible via the Internet. The secondary content server 280 can host an online wagering website and/or a social networking website. The secondary content server 280 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). In some embodiments, the secondary content server 280 can also host social networking accounts, provide social networking content, control social networking communications, store associated social contacts, etc. The secondary content server 280 can also provide chat functionality for a social networking website, a chat application, or any other social networking communications mechanism. In some embodiments, the secondary content server 280 can utilize player data to determine marketing promotions that may be of interest to a player account. The secondary content server 280 can also analyze player data and generate analytics for players, group players into demographics, integrate with third party marketing services and devices, etc. The secondary content server 280 can also provide player data to third parties that can use the player data for marketing. In some embodiments, the secondary content server 280 can provide one or more social networking communication mechanisms that publish (e.g., post, broadcast, etc.) a message to a mass (e.g., to multiple people, users, social contacts, accounts, etc.). The social networking communication mechanism can publish the message to the mass simultaneously. Examples of the published message may include, but not be limited to, a blog post, a mass message post, a news feed post, a profile status update, a mass chat feed, a mass text message broadcast, a video blog, a forum post, etc. Multiple users and/or accounts can access the published message and/or receive automated notifications of the published message.

The wagering game system architecture 200 can also include a remote configuration and download (RCD) server 290 configured to manage configuration of wagering game environments. The RCD server 290 can include a processor 291 configured to process requests for configuration of wagering game environments. The RCD server 290 can also include a wagering-game, dynamic configuration module 292 configured to dynamically convert and evaluate mathematical expressions from a configuration data source (e.g., a configuration file) in response to a request to configure a wagering game environment.

Each component shown in the wagering game system architecture 200 is shown as a separate and distinct element connected via a communications network 222. However, some functions performed by one component could be performed by other components. For example, the wagering game server 250 can also be configured to perform functions of the application management module 263, and other network elements and/or system devices. Furthermore, the components shown may all be contained in one device, but some, or all, may be included in, or performed by, multiple devices, as in the configurations shown in FIG. 2 or other configurations not shown. For example, the account manager 253 and the communication unit 254 can be included in the wagering game machine 260 instead of, or in addition to, being a part of the wagering game server 250. Further, in some embodiments, the wagering game machine 260 can determine wagering game outcomes, generate random numbers, etc. instead of, or in addition to, the wagering game server 250.

The wagering game machines described herein (e.g., wagering game machine 260) can take any suitable form, such as floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
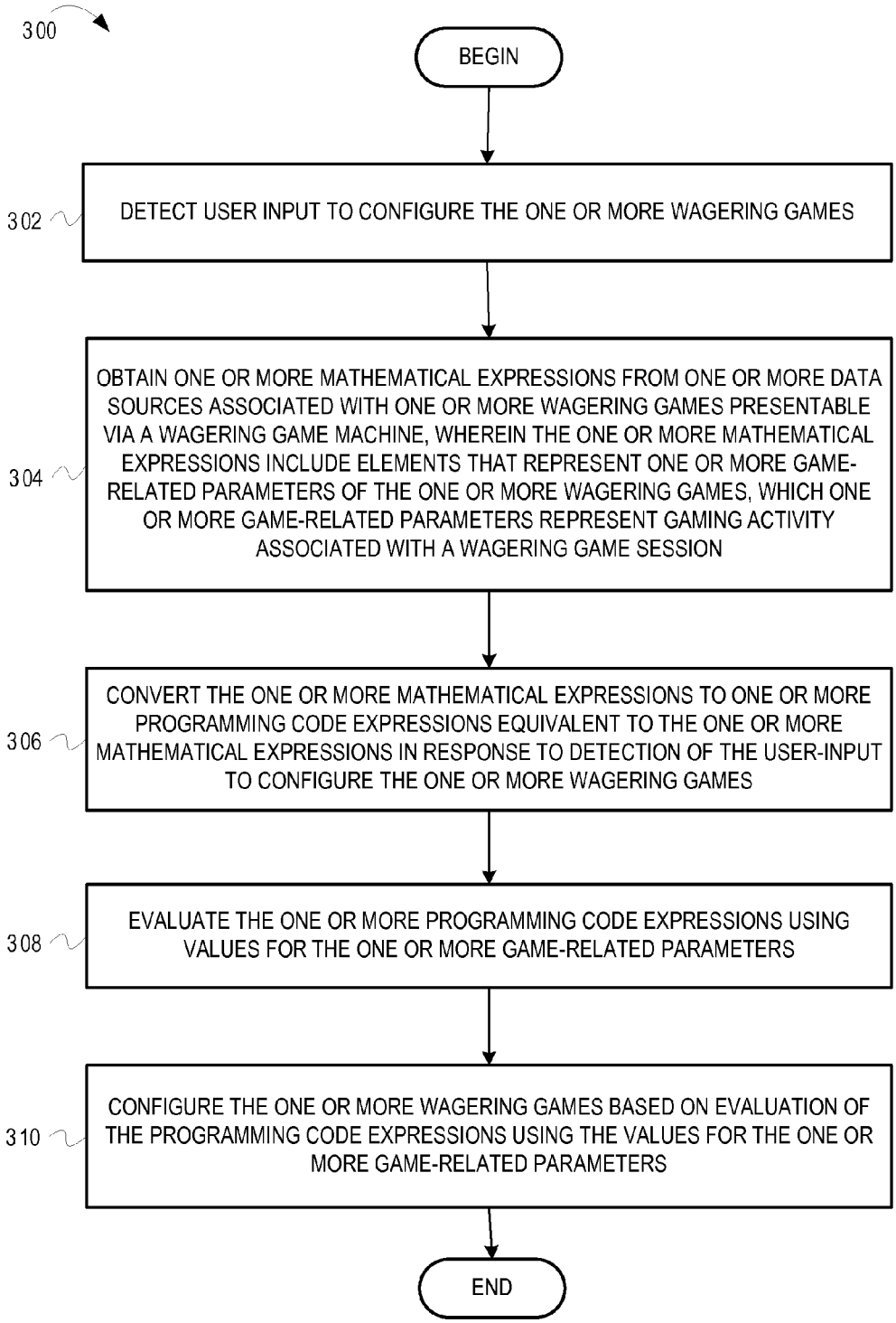
FIG. 3 is a flow diagram 300 illustrating dynamically configuring wagering game environments, according to some embodiments.
Figure 4:
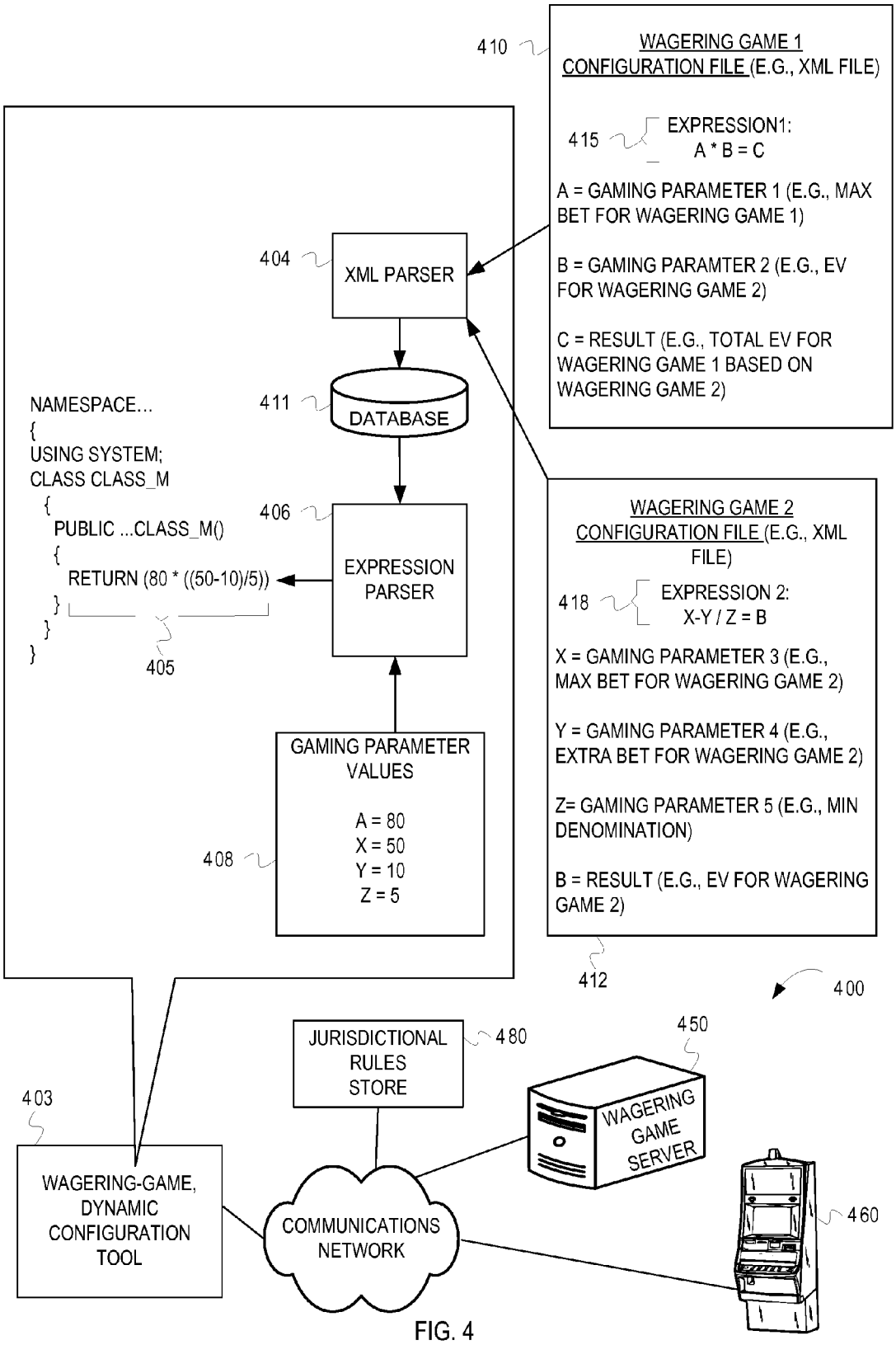
FIG. 4 is an illustration of dynamically configuring wagering-game environments that present multiple wagering games, according to some embodiments.

FIG. 3 is a flow diagram ("flow") 300 illustrating dynamically configuring wagering game environments, according to some embodiments. FIG. 4 is a conceptual diagram that helps illustrate the flow of FIG. 3, according to some embodiments. This description will present FIG. 3 in concert with FIG. 4. In FIG. 3, the flow 300 begins at processing block 302, where a wagering game system ("system") detects user input to configure the one or more wagering games. For example, the system can detect a selection of an object that represents a wagering game machine via a user interface that is configured to receive user input for configuration of a wagering game. The user interface can present primary and secondary wagering games that are available to configure for the wagering game machine.

The flow 300 continues at processing block 304, where the system obtains one or more mathematical expressions from one or more data sources associated with one or more wagering games presentable via a wagering game machine, wherein the one or more mathematical expressions include elements that represent one or more game-related parameters of the one or more wagering games, which one or more game-related parameters represent gaming activity associated with a wagering game session. In one embodiment, the one or more data sources are one or more configuration files. In one embodiment, the system uses the mathematical expression to build a class that can includes functions, methods, etc., that receive specific input parameters, as described, for example, in FIG. 4. FIG. 4 is a conceptual diagram that illustrates an example of dynamically configuring wagering-game environments that present multiple wagering games, according to some embodiments. In FIG. 4, a wagering-game, dynamic configuration tool ("configuration tool") 403, is connected to a jurisdictional rules store 480, a wagering game server 450, and a wagering game machine 460. The configuration tool 403 may be included in, or be associated with a server, such as an RCD server. The configuration tool 403 is configured to present a user interface through which a user can select one or more objects that represent one or more specific wagering game machine(s) and/or group of wagering game machines, such as the wagering game machine 460. For instance, once the operator selects an object that represents the wagering game machine 460, the configuration tool 403 is configured to assist in installing specific games on the wagering game machine 460, such as a primary wagering game and one or more secondary wagering games. In some embodiments, the configuration tool 403 can access primary wagering game content stored on the wagering game machine 460 and/or on the wagering game server 450. The operator can further configure wagering games on the wagering game machine 460 and/or the wagering game server 450, via the user interface, with specific information that is related to gaming and which makes the wagering games work properly according to gaming rules and regulations. For example, the configuration tool 403 presents a secondary wagering game to be configured and the configuration tool 403 initiates a secondary game configuration wizard. The configuration tool 403 parses a first configuration file 410 associated with the secondary wagering game. The configuration tool 403 parses elements of a first mathematical expression ("first expression") 415 (i.e., "A*B=C") from the first configuration file 410. The configuration tool 403 determines that the first expression 415, if evaluated, would evaluate to a result "C" which can represent a combined EV for the secondary wagering game played in connection with a primary wagering game, given input elements "A" and "B." One of the elements, "B," refers to an EV for the primary wagering game for the wagering game machine 460. Another of the elements, "A" represents a maximum bet for the secondary wagering game. The configuration tool 403 determines the name of the primary wagering game and selects a configuration file associated with the primary wagering game, configuration file 412. The configuration tool 403 (e.g., via the XML parser 404) parses a second expression 418 (i.e., "X−Y/Z=B") from the configuration file 412 associated with the primary wagering game. The first expression 415 may also be referred to as a "parent" expression and the second expression 418 may be referred to as a "child" expression because a result of the second expression 418 (i.e., the element "B") is a component of the first expression 415.

In some embodiments, the configuration tool 403 parses the configuration files 410 and 412 prior to a request to configure the wagering games for the wagering game machine 460. For example, the configuration tool 403 may parse the configuration files and store the parsed data in a database 411 until a request is made to configure the wagering games for the wagering game machine 460. Some possible elements that could appear in either of the configuration files 410 and 412 may include, but not be limited to the following:

Odds of adding a win for the primary wagering game ("base game") to a secondary wagering game's credit meter.

A required bet per line.

A list of permissible denominations for the base game that are deemed compatible to the secondary wagering game.

Base game line configurations supported for a specific master game configuration.

A list of specific max bet values permitted.

A minimum max bet value list for a secondary wagering game. The values specified may be required to match the base game's minimum max bet value.

A list of base game themes.

An average multiplier awarded to a casino patron ("patron"), or player, during a bonus.

An identifier number of a client application permitted to be downloaded to a wagering game machine.

A name of one or more configuration files.

An EV, or average payback, for the secondary wagering game appended to the base game.

A percentage of a minimum max bet to be used for an extra bet.

An identifier of a percentage of a base game bet to be used for an extra bet.

An absolute number of credits for an extra bet per line bet.

An element that forces a denomination for the secondary wagering game to match the base game's denomination.

A maximum allowed bet in cash that a player is permitted to make for the base game.

A maximum allowed bet, in credits, a player is permitted to make.

A minimum allowed bet, in cash, a player is permitted to make.

A minimum EV, or minimum payback for the secondary wagering game appended to the base game.

A minimum allowed bet, in cash, a player is permitted to make.

A minimum allowed maximum total bet, in cash, a player is permitted to make in order to participate in a game.

A minimum scaled denomination to allow an operator to scale reset values based on a desired denomination.

Odds of awarding a mystery prize.

An amount of a mystery prize in credits.

A value used to specify a threshold at which a progressive configuration becomes eligible to trigger.

Returning momentarily to FIG. 3, the flow 300 continues at processing block 306, where the system converts the one or more mathematical expressions to one or more programming code expressions equivalent to the one or more mathematical expressions in response to detection of the user-input to configure the one or more wagering games. For example, in FIG. 4, an expression parser 406 converts the first expression 410 and the second expression 412 to one or more programming code expressions, such as the expression 405, which is a combination of the first expression 415 and the second expression 418. The expression parser 406 converts the mathematical expressions and elements of configuration files 410 and 412 into programming language code (e.g., using the syntax, form, expressions, symbols, etc. of a specific programming language). In some embodiments, the configuration tool 403 generates a class for use with the programming code expressions. The configuration tool 403 can generate variables, and other objects, within the programming code to represent the elements of the expressions which represent the game-related parameters.

Returning momentarily to FIG. 3, the flow 300 continues at processing block 308, where the system evaluates the programming code expressions using values for the one or more game-related parameters. For example, in FIG. 4, the configuration tool 403 evaluates the expression 405, which, by insertion of one or more values for the game-related parameters ("gaming parameter values") 408, generates a result, such as a total EV value for the secondary wagering game as combined with play of the primary wagering game. For example, the configuration tool 403 can compile the programming code at runtime and pass the one or more values for the game-related parameters ("gaming parameter values") 408 to methods and other functions via use of the class. In some embodiments, the configuration tool 403 assigns a mathematical parser source program to a string variable within a host program. The source code contained in the string variable includes two arguments which are the programming code expression and the variable list used by the programming code expression, which variable list represents the elements of the original mathematical expressions 415 and 418. The host code will receive the programming code expression and the list of variables, set those two items into a string containing the parser source code, compile the parser source code, and execute the parser. The return value of the parser is the EV of the base game and secondary game combination. An executable, generated in this process, resides in memory and remains there only for the duration of execution. Using the total EV (e.g., the evaluated value for the "C" element of the mathematical expression 415), the configuration tool 403 can configure the secondary wagering game.

Returning again to FIG. 3, the flow 300 continues at processing block 310, where the system configures the one or more wagering games based on evaluation of the one or more programming code expressions using the values for the one or more game-related parameters. For example, the system can generate an EV for a wagering game (e.g., such as an EV for a secondary wagering game in combination with a primary wagering game) and determine that the EV comports with one or more jurisdictional rules in which the wagering game machine resides. The system can further determine one or more settings that are allowed for the one or more wagering games in response to determining that the expected value comports with one or more jurisdictional rules. The setting values may be allowable pay tables, allowable maximum bet values, allowable denomination values, etc. that fall within a range of permitted EV values by the jurisdictional rules. The system can further present the one or more settings values via a user interface based at least in part on the selection of an object within the user interface that represents the wagering game machine.

Additional Example Operating Environments

This section describes additional example operating environments and presents structural aspects of some embodiments.

Wagering Game Machine Architecture

Figure 5:
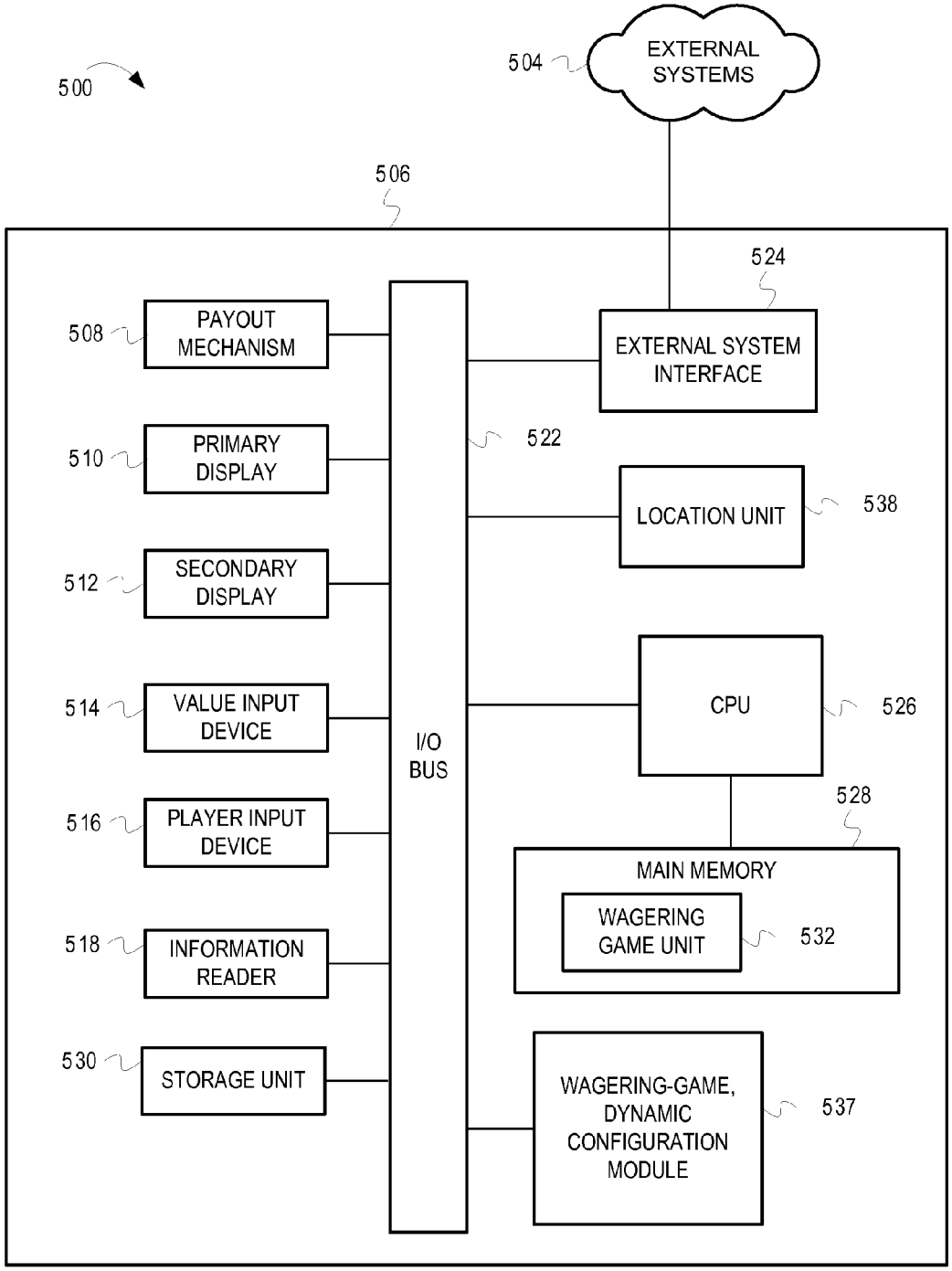
FIG. 5 is an illustration of a wagering game machine architecture 500, according to some embodiments.

FIG. 5 is a conceptual diagram that illustrates an example of a wagering game machine architecture 500, according to some embodiments. In FIG. 5, the wagering game machine architecture 500 includes a wagering game machine 506, which includes a central processing unit (CPU) 526 connected to main memory 528. The CPU 526 can include any suitable processor, such as an Intel® Pentium processor, Intel® Core 2 Duo processor, AMD Opteron™ processor, or UltraSPARC processor. The main memory 528 includes a wagering game unit 532. In some embodiments, the wagering game unit 532 can present wagering games, such as video poker, video black jack, video slots, video lottery, reel slots, etc., in whole or part.

The CPU 526 is also connected to an input/output ("I/O") bus 522, which can include any suitable bus technologies, such as an AGTL+frontside bus and a PCI backside bus. The I/O bus 522 is connected to a payout mechanism 508, primary display 510, secondary display 512, value input device 514, player input device 516, information reader 518, and storage unit 530. The player input device 516 can include the value input device 514 to the extent the player input device 516 is used to place wagers. The I/O bus 522 is also connected to an external system interface 524, which is connected to external systems 504 (e.g., wagering game networks). The external system interface 524 can include logic for exchanging information over wired and wireless networks (e.g., 802.11g transceiver, Bluetooth transceiver, Ethernet transceiver, etc.)

The I/O bus 522 is also connected to a location unit 538. The location unit 538 can create player information that indicates the wagering game machine's location/movements in a casino. In some embodiments, the location unit 538 includes a global positioning system (GPS) receiver that can determine the wagering game machine's location using GPS satellites. In other embodiments, the location unit 538 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 5, in some embodiments, the location unit 538 is not connected to the I/O bus 522.

In some embodiments, the wagering game machine 506 can include additional peripheral devices and/or more than one of each component shown in FIG. 5. For example, in some embodiments, the wagering game machine 506 can include multiple external system interfaces 524 and/or multiple CPUs 526. In some embodiments, any of the components can be integrated or subdivided.

In some embodiments, the wagering game machine 506 includes a wagering-game, dynamic configuration module 537. The wagering-game, dynamic configuration module 537 can process communications, commands, or other information, where the processing can dynamically configure wagering games and wagering game machines.

Furthermore, any component of the wagering game machine 506 can include hardware, firmware, and/or machine-readable storage media including instructions for performing the operations described herein.

Wagering Game Machine

Figure 6:
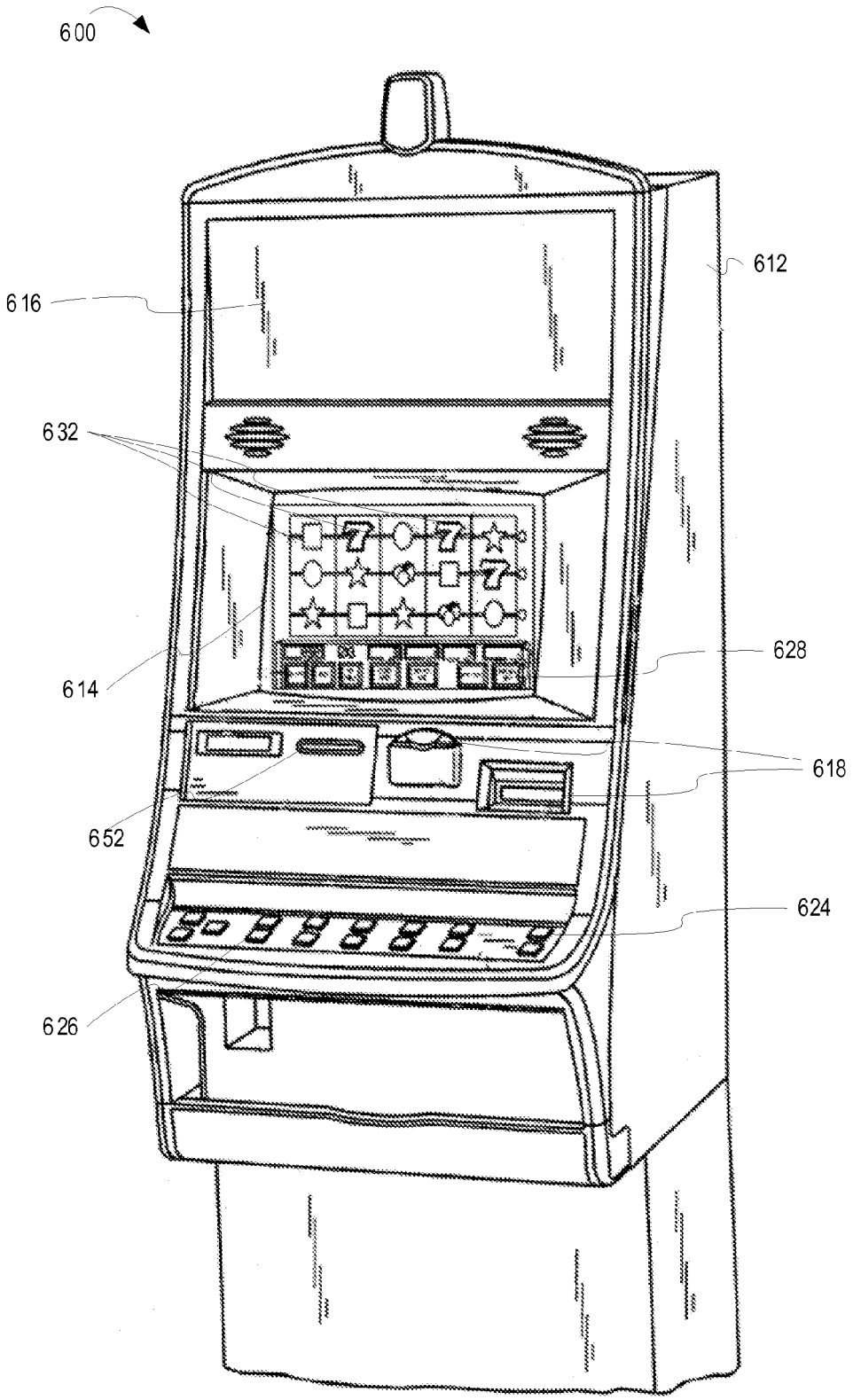
FIG. 6 is an illustration of a wagering game machine 600, according to some embodiments.

FIG. 6 is a conceptual diagram that illustrates an example of a wagering game machine 600, according to some embodiments. Referring to FIG. 6, the wagering game machine 600 can be used in gaming establishments, such as casinos. According to some embodiments, the wagering game machine 600 can be any type of wagering game machine and can have varying structures and methods of operation. For example, the wagering game machine 600 can be an electromechanical wagering game machine configured to play mechanical slots, or it can be an electronic wagering game machine configured to play video casino games, such as blackjack, slots, keno, poker, blackjack, roulette, etc.

The wagering game machine 600 comprises a housing 612 and includes input devices, including value input devices 618 and a player input device 624. For output, the wagering game machine 600 includes a primary display 614 for displaying information about a basic wagering game. The primary display 614 can also display information about a bonus wagering game and a progressive wagering game. The wagering game machine 600 also includes a secondary display 616 for displaying wagering game events, wagering game outcomes, and/or signage information. While some components of the wagering game machine 600 are described herein, numerous other elements can exist and can be used in any number or combination to create varying forms of the wagering game machine 600.

The value input devices 618 can take any suitable form and can be located on the front of the housing 612. The value input devices 618 can receive currency and/or credits inserted by a player. The value input devices 618 can include coin acceptors for receiving coin currency and bill acceptors for receiving paper currency. Furthermore, the value input devices 618 can include ticket readers or barcode scanners for reading information stored on vouchers, cards, or other tangible portable storage devices. The vouchers or cards can authorize access to central accounts, which can transfer money to the wagering game machine 600.

The player input device 624 comprises a plurality of push buttons on a button panel 626 for operating the wagering game machine 600. In addition, or alternatively, the player input device 624 can comprise a touch screen 628 mounted over the primary display 614 and/or secondary display 616.

The various components of the wagering game machine 600 can be connected directly to, or contained within, the housing 612. Alternatively, some of the wagering game machine's components can be located outside of the housing 612, while being communicatively coupled with the wagering game machine 600 using any suitable wired or wireless communication technology.

The operation of the basic wagering game can be displayed to the player on the primary display 614. The primary display 614 can also display a bonus game associated with the basic wagering game. The primary display 614 can include a cathode ray tube (CRT), a high resolution liquid crystal display (LCD), a plasma display, light emitting diodes (LEDs), a three-dimensional (3D) display, or any other type of display suitable for use in the wagering game machine 600. Alternatively, the primary display 614 can include a number of mechanical reels to display the outcome. In FIG. 6, the wagering game machine 600 is an "upright" version in which the primary display 614 is oriented vertically relative to the player. Alternatively, the wagering game machine can be a "slant-top" version in which the primary display 614 is slanted at about a thirty-degree angle toward the player of the wagering game machine 600. In yet another embodiment, the wagering game machine 600 can exhibit any suitable form factor, such as a free standing model, bar top model, mobile handheld model, or workstation console model.

A player begins playing a basic wagering game by making a wager via the value input device 618. The player can initiate play by using the player input device's buttons or touch screen 628. The basic game can include arranging a plurality of symbols 632 along a pay line, which indicates one or more outcomes of the basic game. Such outcomes can be randomly selected in response to player input. At least one of the outcomes, which can include any variation or combination of symbols, can trigger a bonus game.

In some embodiments, the wagering game machine 600 can also include an information reader 652, which can include a card reader, ticket reader, bar code scanner, RFID transceiver, or computer readable storage medium interface. In some embodiments, the information reader 652 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method comprising:

obtaining one or more mathematical expressions in a non-programming code format from one or more data sources associated with a wagering game presentable via a wagering game machine, wherein the one or more mathematical expressions include game-related parameters that represent one or more gaming activities associated with a wagering game session;

detecting user input, via one or more input devices, to configure the wagering game;

converting the one or more mathematical expressions in the non-programming code format to one or more equivalent programming code expressions in a programming code format in response to the detecting the user input, wherein the one or more programming code expressions comprise a function for an expected value of the wagering game;

determining one or more values for the one or more game-related parameters;

via use of one or more processors, evaluating the function for the expected value using the one or more values for the one or more game-related parameters;

generating the expected value for the wagering game in response to the evaluating the function for the expected value; and configuring the wagering game using the expected value.

2. The computer-implemented method of claim 1, wherein the converting comprises:

automatically generating a class in the programming code format that includes the one or more programming code expressions in the programming code format, wherein the evaluating and the generating include using the class.

3. The computer-implemented method of claim 1, wherein the configuring the wagering game using the expected value comprises:

determining that the expected value comports with one or more jurisdictional rules in which the wagering game machine resides; and determining one or more settings that are allowed for the wagering game in response to the determining that the expected value comports with the one or more jurisdictional rules.

4. The computer-implemented method of claim 3, wherein the one or more settings are associated with one or more of one or more allowable pay tables, one or more allowable maximum bet values, and one or more allowable denomination values for the wagering game based on the one or more jurisdictional rules.

5. The computer-implemented method of claim 1, wherein the expected value is for a primary wagering game, and wherein the one or more programming code expressions further comprise an additional function for an additional expected value for a potential payout of a secondary wagering game, wherein the additional function for the additional expected value is based, at least in part, on the function for the expected value of the primary wagering game.

6. The computer-implemented method of claim 1, wherein the one or more data sources comprise one or more configuration files.

7. One or more non-transitory, machine-readable storage media having instructions stored thereon, which when executed by a set of one or more processors causes the set of one or more processors to perform operations comprising:

obtaining one or more mathematical expressions in a non-programming code format from one or more configuration files associated with a wagering game presentable via a wagering game machine, wherein the one or more mathematical expressions include game-related parameters that represent one or more gaming activities associated with a wagering game session;

detecting user input to configure the one or more wagering games;

converting the one or more mathematical expressions in the non-programming code format to one or more equivalent programming code expressions in a programming code format in response to the detecting the user input, wherein the one or more equivalent programming code expressions comprise a function for an expected value of the wagering game;

determining one or more values for the one or more game-related parameters;

evaluating the function for the expected value using the one or more values for the one or more game-related parameters;

generating the expected value for the wagering game in response to the evaluating the function for the expected value; and configuring the wagering game using the expected value.

8. The one or more non-transitory, machine-readable storage media of claim 7, wherein the converting comprises:

automatically generating a class in the programming code format that includes the one or more programming code expressions in the programming code format, wherein the evaluating and the generating include using the class.

9. The one or more non-transitory, machine-readable storage media of claim 7, wherein the configuring the wagering game using the expected value comprises:

determining that the expected value comports with one or more jurisdictional rules in which the wagering game machine resides; and determining one or more settings that are allowed for the wagering game in response to the determining that the expected value comports with the one or more jurisdictional rules.

10. The one or more non-transitory, machine-readable storage media of claim 9, wherein the one or more settings are associated with one or more of one or more allowable pay tables, one or more allowable maximum bet values, and one or more allowable denomination values for the wagering game based on the one or more jurisdictional rules.

11. The one or more non-transitory, machine-readable storage media of claim 7, wherein the expected value is for a primary wagering game, and wherein the one or more programming code expressions further comprise an additional function for an additional expected value for a potential payout of a secondary wagering game, wherein the additional function for the additional expected value is based, at least in part, on the function for the expected value of the primary wagering game.

12. A system comprising:

at least one input device configured to receive an indication of a wager to play a wagering game presentable via a wagering game machine;

at least one display device configured to display the wagering game, the display device being capable of stereoscopic, three-dimensional visual effects;

at least one processor; and at least one memory device storing instructions which, when executed by the at least one processor, cause the system to:

obtain one or more mathematical expressions in a non-programming code format from one or more data sources associated with the wagering game, wherein the one or more mathematical expressions include game-related parameters that represent one or more gaming activities associated with a wagering game session;

detect user input to configure the wagering game;

convert the one or more mathematical expressions in the non-programming code format to one or more equivalent programming code expressions in a programming code format in response to detection of the user input, wherein the one or more programming code expressions comprise a function for an expected value of the wagering game;

determine one or more values for the one or more game-related parameters;

evaluate the function for the expected value using the one or more values for the one or more game-related parameters;

generate the expected value for the wagering game in response to evaluation of the function for the expected value; and configure the wagering game using the expected value.

13. The system of claim 12, wherein the instructions to convert the one or more mathematical expressions in the non-programming code format to the one or more programming code expressions in the programming code format comprise instructions which, when executed by the at least one processor, cause the system to:

automatically generate a class in the programming code format that includes the one or more programming code expressions in the programming code format; and wherein evaluation of the function for the expected value and generation of the expected value include use of the class.

14. The system of claim 12, wherein the instructions to configure the wagering game using the expected value comprise instructions which, when executed by the at least one processor, cause the system to:

determine that the expected value comports with one or more jurisdictional rules in which the wagering game machine resides; and determine one or more settings that are allowed for the wagering game in response to determination that the expected value comports with the one or more jurisdictional rules.

15. The system of claim 14, wherein the one or more settings are associated with one or more of one or more allowable pay tables, one or more allowable maximum bet values, and one or more allowable denomination values for the wagering game based on the one or more jurisdictional rules.

16. The system of claim 12, wherein the expected value is for a primary wagering game, wherein the one or more programming code expressions further comprise an additional function for an additional expected value for a potential payout of a secondary wagering game, and wherein the additional function for the additional expected value is based, at least in part, on the function for the expected value of the primary wagering game.

17. The system of claim 12, wherein the one or more data sources comprise one or more configuration files.

18. An apparatus comprising:

at least one input device configured to receive an indication of a wager to play one or more wagering games presentable via a wagering game machine;

at least one display device configured to display the one or more wagering games, the display device being capable of stereoscopic, three-dimensional visual effects;

at least one processor; and at least one memory device storing instructions which, when executed by the at least one processor, cause the apparatus to:

obtain one or more mathematical expressions in a non-programming code format from one or more configuration files associated with one or more wagering games, wherein the one or more mathematical expressions include game-related parameters that represent one or more gaming activities associated with a wagering game session, and wherein the one or more mathematical expressions in the non-programming code format indicate a first expected value for a potential payout for a first of the one or more wagering games based, at least in part, on an second expected value for a second one of the one or more wagering games;

detect user input to configure the one or more wagering games;

convert the one or more mathematical expressions in the non-programming code format to one or more equivalent programming code expressions in a programming code format in response to detection of the user input, wherein the one or more equivalent programming code expressions comprise a first function for the first expected value and a second function for the second expected value;

determine one or more values for the one or more game-related parameters;

evaluate the first function for the first expected value and the second function for the second expected value using the one or more values for the one or more game-related parameters;

generate the first expected value and the second expected value for the wagering game in response to evaluation of the first function and the second function; and configure the one or more wagering games using the first expected value and the second expected value.

19. The apparatus of claim 18, wherein the instructions to convert the one or more mathematical expressions in the non-programming code format to the one or more equivalent programming code expressions in the programming code format using the first expected value and the second expected value comprise instructions which, when executed by the at least one processor, cause the system to:

automatically generate a class in the programming code format that includes the one or more programming code expressions in the programming code format; and wherein evaluation of the first function for the first expected value, evaluation of the second function for the second expected value, generation of the first expected value, and generation of the second expected value include use of the class.

20. The apparatus of claim 18, wherein the instructions to configure the one or more wagering games using the first expected value and the second expected value comprise instructions which, when executed by the at least one processor, cause the system to:

determine that one or more of the first expected value and the second expected value comports with one or more jurisdictional rules in which the wagering game machine resides; and determine one or more settings that are allowed for the one or more wagering games in response to determination that the one or more of the first expected value and the second expected value comports with the one or more jurisdictional rules.

21. The apparatus of claim 20, wherein the one or more settings are associated with one or more of one or more allowable pay tables, one or more allowable maximum bet values, and one or more allowable denomination values for the one or more wagering games based on the one or more jurisdictional rules.

22. An apparatus comprising:

means for obtaining one or more mathematical expressions in a non-programming code format from one or more configuration files, wherein the one or more configurations files are associated with primary wagering game and with a second wagering game presentable via a wagering game machine, wherein the one or more mathematical expressions in the non-programming code format include game-related parameters that represent one or more gaming activities associated with a wagering game session, and wherein the one or more mathematical expressions in the non-programming code format indicate a first expected value for potential payout of the secondary wagering game based, at least in part, on a second expected value of the primary wagering game;

means for detecting user input to configure the primary wagering game and the second wagering game;

means for converting the one or more mathematical expressions in the non-programming code format to one or more programming code expressions in a programming code format in response to detection of the user input, wherein the one or more programming code expressions are equivalent to the non-one or more mathematical expression, and wherein the one or more programming code expressions comprise a first function for the first expected value and a second function for the second expected value;

means for evaluating the first function for the first expected value and the second function for the second expected value using the one or more values for the one or more game-related parameters;

means for generating the first expected value and the second expected value for the wagering game in response to evaluation of the first function and the second function; and means for configuring the primary wagering game and the second wagering game using the first expected value and the second expected value.

23. The apparatus of claim 22, wherein the means for converting comprises:

means for automatically generating a class in the programming code format that includes the one or more programming code expressions in the programming code format; and wherein the means for evaluating and the means for generating include means for using the class.

24. The apparatus of claim 23, wherein the means for configuring the primary wagering game and the secondary wagering game using the first expected value and the second expected value comprise:

means for determining that one or more of the first expected value and the second expected value comports with one or more jurisdictional rules in which the wagering game machine resides; and means for determining one or more settings that are allowed for the primary wagering game and the secondary wagering game in response to determining that the first expected value and the second expected value comports with the one or more jurisdictional rules.

25. The apparatus of claim 24, wherein the one or more settings are associated with one or more of one or more allowable pay tables, one or more allowable maximum bet values, and one or more allowable denomination values for the primary wagering game and the secondary wagering game based on the one or more jurisdictional rules.

26. The computer-implemented method of claim 1, wherein the one or more mathematical expressions in the non-programming code format comprise a string of symbols and operators organized into a first format that is not compatible with syntax of a programming language, and wherein the converting the one or more mathematical expressions to the one or more programming code expressions in the programming code format comprises changing the string of symbols and operators into the programming code format, wherein the programming code format is compatible with the syntax of the programming language.

27. The computer-implemented method of claim 1, wherein the one or more mathematical expressions in the non-programming code format are stored in a configuration file, wherein the configuration file comprises extensible markup language format, and wherein the converting the one or more mathematical expressions in the non-programming code format to the one or more programming code expressions comprises converting the extensible markup language format to a programming language format, wherein the programming language comprises one or more of C#, Javascript, Java, C++, the Adobe® Flash® programming language, the Microsoft® Silverlight™ programming language, the Adobe® Air™ programming language, and hyper-text markup language.

28. The computer-implemented method of claim 1, further comprising compiling the one or more programming code expressions in the programming code format after the converting the one or more mathematical expressions in the non-programming code format to the one or more programming code expressions in the programming code format.

29. A system comprising:

one or more processors; and one or more memory storage devices configured to store instructions which, when executed by at least one of the one or more processors, cause the system to:

obtain one or more mathematical expressions in a non-programming code format from one or more data sources associated with the wagering game, wherein the one or more mathematical expressions include game-related parameters that represent one or more gaming activities associated with a wagering game session;

detect user input to configure the wagering game;

convert the one or more mathematical expressions in the non-programming code format to one or more equivalent programming code expressions in a programming code format in response to detection of the user input, wherein the one or more programming code expressions comprise a function for an expected value of the wagering game;

determine one or more values for the one or more game-related parameters;

evaluate the function for the expected value using the one or more values for the one or more game-related parameters;

generate the expected value for the wagering game in response to evaluation of the function for the expected value; and configure the wagering game using the expected value.

* * * * *